United States Patent [19]

Rasmussen

[11] 3,971,237

[45] July 27, 1976

[54] DOOR LOCK

[75] Inventor: Holgar Rasmussen, Kilchberg, Switzerland

[73] Assignee: Georgia-Pacific Corporation, Portland, Oreg.

[22] Filed: July 9, 1975

[21] Appl. No.: 594,256

[52] U.S. Cl. ..... 70/99; 70/401; 70/405; 292/87

[51] Int. Cl.[2] ..... E05B 65/08; E05C 19/06

[58] Field of Search ..... 70/99, 96, 97, 79, 80, 70/401, 405; 292/86, 87, 88, 89

[56] References Cited

UNITED STATES PATENTS

| | | | |
|---|---|---|---|
| 459,978 | 9/1891 | Pickett | 70/405 |
| 742,563 | 10/1903 | Beehler | 292/86 |
| 3,522,963 | 8/1970 | Farnden | 292/86 |
| 3,855,829 | 12/1974 | Lipschutz | 70/362 |

*Primary Examiner*—Paul R. Gilliam
*Assistant Examiner*—Kenneth J. Dorner

[57] ABSTRACT

A lock for sliding doors for cabinets and the like. A shoulder on a catch element carried by the door extends through a lock opening in the cabinet frame and engages the edge thereof to secure the door. A key of particular length moves the shoulder from the locked position to an intermediate position at which it can pass outwardly through the back opening. If the catch element is moved too far, a second shoulder engages the edge of the lock opening and the door cannot be opened.

16 Claims, 4 Drawing Figures

DOOR LOCK

BACKGROUND OF THE INVENTION

This invention relates generally to locks for doors and more particularly to catch-type locks for use in paper towel dispenser cabinets and the like.

Locks used to secure doors for cabinets such as those used to dispense paper towels and toilet tissues must be effective and simple. They must frustrate unauthorized attempts to open the doors to prevent vandalism and thievery, but the nature of the device requires them to be inexpensive and not affected by moisture and the like. In prior art devices, these two requirements have for the most part been mutually exclusive. While the prior art includes many quite effective locks or catches, they are usually complicated, and thus are expensive and prone to failure. The more simple locks have generally been less effective, many to the point where vandalism and thievery are not prevented.

SUMMARY OF THE INVENTION

The object of this invention is to provide a simple and effective lock for doors such as those used in cabinets for dispensing paper towels and tissue. The invention overcomes the deficiencies in the prior art devices.

This invention can be used with many types of doors, providing the relationship between door and frame is such that the lock catch element can be manipulated from the locked to the open position by the key, as described below. The invention comprises three components: a catch element, a lock opening, and a key. The catch element can be positioned on the inside of the door or on the frame, with the lock opening on the other. The catch element protrudes through the lock opening when the door is in its closed position. The catch element comprises at least one, and preferably two, spaced parallel legs, each of which terminates in a free end. Carried by each free end is a pair of shoulders, oriented at angles to one another. The catch element is movable between three positions. It is biased toward a locking position, in which one of the shoulders engages a first position of the edge of the lock opening to secure the door. The catch element is movable by the key from the locking position to an open position, at which point the lock opening is large enough to allow passage of both shoulders. The catch element is also movable beyond the open position to a third position, in which position the other of the shoulders engages a second portion of the edge of the lock opening. The catch element legs are most advantageously laterally movable between the various positions, but it could also be rotatably movable between three angularly spaced positions.

The configuration of the locking opening depends upon the type of movement described by the catch element, and the orientation of the shoulders. If the movement of the catch element is lateral, and the shoulders are opposite one another, the lock opening is so sized and configured as to cause the second shoulder to engage the lower edge of the opening if the catch element is depressed too far. Or, the second shoulder can be at 90° to the first, and the lock opening provided with a narrowed part at its lower portion, so that if depressed too far the second shoulder engages the side edge of the opening.

The special key preferably has two spaced parallel legs which fit through a pair of openings in the member in which the catch element is installed. The key legs engage and move the catch legs. The key can be inserted only a predetermined distance, sufficient to move the catch legs into the open position. At the points at which the key legs engage the catch legs, the latter is provided with a small surface to be engaged by the key legs, flanked by inclined surfaces that will deflect unauthorized instruments inserted through the key openings. The key openings can also be of special configuration, to which the key is matched, in order to frustrate the use of unauthorized implements.

This invention provides four impediments to unauthorized opening. First, there are preferably two catch legs that must simultaneously be moved to the open position. Second, these legs must be moved a specific distance, no more, no less, in order to arrive at the open position. Third, each catch leg has inclined surfaces to frustrate attempts to move the legs by wires or the like. Fourth, the openings in the cabinet door can be sized and configured to block unauthorized implements.

Thereby, this invention is quite effective, while being extremely simple in design and operation. It has only three components, none of which is complex. It is not susceptible to deterioration or contamination. It is versatile, because the catch element can be placed on the door or on the frame, and within the basic principles of the invention, many variations of component design and movement are possible. Finally, by virtue of its simplicity, the lock is easily and inexpensively produced.

DESCRIPTION OF A PREFERRED EMBODIMENT

Figure 1:
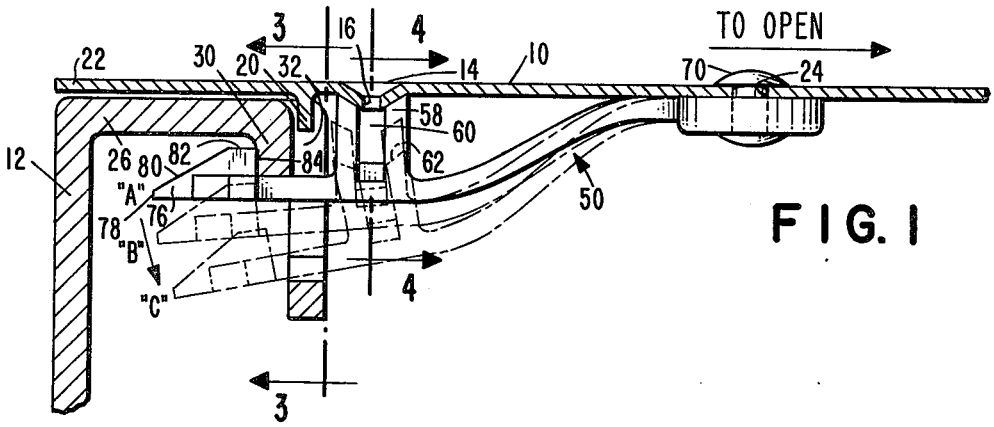
FIG. 1 is an elevational view, partially in section, of a preferred embodiment of the locking device of this invention.
Figure 2:
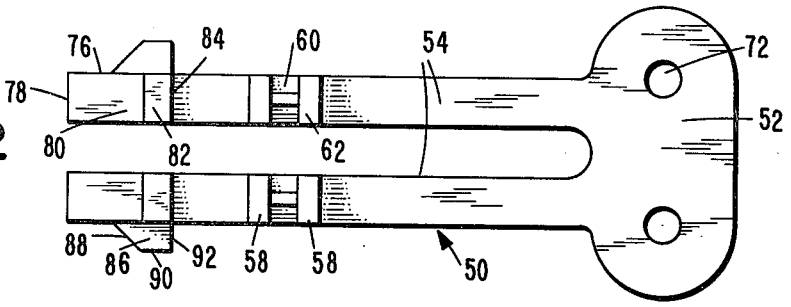
FIG. 2 is a top plan view of the catch member of FIG. 1.
Figure 3:
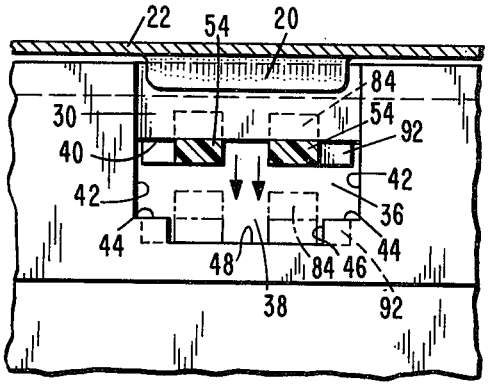
FIG. 3 is a view taken along line 3—3 of FIG. 1.
Figure 4:
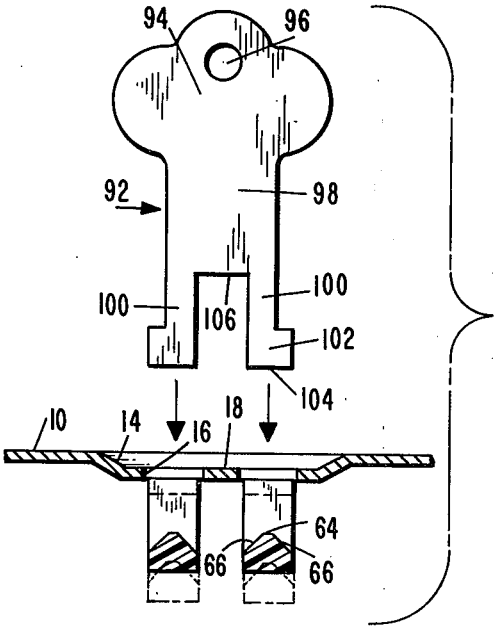
FIG. 4 is a view taken along line 4—4 of FIG. 1, and showing the key for operating the lock in position for insertion.

This lock is described herein in the context of use in locking a sliding door or the like, such as are commonly found in rest room towel or tissue dispensers. That is, a door which moves, at least for that part of its movement immediately adjacent to the frame, substantially in the direction indicated by the arrow in FIG. 1. However, the lock will work properly in other types of doors as well, provided the necessary arrangement of the various components can be accommodated.

The movable door member (or cabinet member) is indicated as 10 and the stationary frame member as 12. Door member 10 comprises a recessed portion 14 at the base of which are a pair of identical key openings 16, separated by a median strip 18. Key openings 16 are shown as being rectangular, but they may be of other suitable configurations to which the key can be matched. A flange 20 protrudes downwardly from the underside of door member 10, and it terminates in an end portion 22 that extends over frame member 12. A pair of holes 24 are provided in door member 10 to receive the means for attaching the lock catch element.

Frame member 12 is generally attached to a wall or panel, and is stationary with respect to door 10. Frame member 12 has a top portion 26 over which door 10 extends. Frame member 12 also comprises a front portion 30, which has a frame recess 32. Flange 20 abutts the upper portion of frame recess 32 to limit to movement of door 10 during closing. Within frame 32, front portion 30 defines the edges of a lock opening which has a main opening portion 36 and an auxiliary opening portion 38. Main portion 36 is bounded at the top by a locking edge 40 and at its bottom by discontinuous bottom edges 44. Auxiliary portion 38 is of lesser width than main portion 36, and is bounded on its sides by side edges 46 and at its bottom by a bottom edge 48.

The catch element is generally indicated as 50. It is constructed of flexible or resiliant material such as plastic. It comprises an attachment portion 52 and a pair of spaced parallel legs 54. Viewed from the side (FIG. 1), legs 54 each have a curved intermediate portion. They also have, at an intermediate point, a pair of spaced upstanding flanges 58 which define therebetween a key channel 60. Each flange 58 terminates at its upper end in an end surface 62, sloped inwardly toward channel 60. At the base of each channel 60 is key contact portion having a flattened contact surface 64 and a pair of downwardly inclined side surfaces 66. Catch 50 is biased upwardly. In its at rest, or locked position, each channel 60 is aligned directly beneath a key opening 16 in door member 10. Surfaces 62 engage the underside of recess 14 to limit the upward movement of catch 50, and to insure that channels 60 are aligned with key openings 16. Catch 50 is attached to door member 10 by means of rivets or bolts 70 passing through openings 72 in catch 50 and openings 24 in door member 10.

Each leg 54 terminates at its free end in an upstanding abuttment 76, which has a leading edge 78, a camming surface 80, a top surface 82, and a shoulder 84. Adjacent to each upstanding abuttment 76 is a sidewardly extending abuttment 86, which has a camming surface 88, a side surface 90, and a shoulder 92. The maximum height of each leg 54 measured at abuttment 76 is slightly less than the height of main opening portion 36, measured between edges 40 and 44. The width of catch 50, measured between the two side surfaces 90, is slightly less than the width of main opening portion 36, but is greater than the width of auxiliary opening portion 38, measured between edges 46. Legs 54 can be separately moved with respect to one another.

A special key 92 is necessary to unlock a door equipped with this lock. Key 92 comprises a handle portion 94 having the usual opening 96 for receiving a key chain or the like, and a shank portion 98, and a pair of legs 100. A widened portion 102 is at the free end of each leg 100, terminating in an operating surface 104. A shank base surface 106 is positioned between legs 100. The width of base surface 106 is slightly greater than that of median strip 18. The width of operating surfaces 104 is slightly less than the width of openings 16. The thickness of legs 100 is slightly less than the depth of openings 16. Channels 60 are appreciably deeper than the thickness of legs 100. It should be noted that while key 92 is shown herein as being of straight, flat plate, its cross-sectional configuration could be other than that, such as arcuate, with openings 16 altered in a matching fashion.

The length of legs 100 is critical. With key 92 inserted so that shank base surface 106 is in contact with median strip 18, and with operating surfaces 104 contacting surfaces 64 in channels 60, legs 100 must be of exactly such length as to cause catch member 50 to assume the middle position shown in broken lines in FIG. 1 and labeled "B". The reason for this criticality will become obvious from a consideration of the operation of the device, as explained below.

Catch element 50 is biased to its uppermost position, shown in FIG. 1 in solid lines, and labeled "A". In this position, with the door open, the upper surfaces 62 of flanges 58 rest against the underside of recess 14. When the door 10 is closed, leading edge 78 goes through main lock opening portion 36, until cam surface 80 engages upper edge 40, camming catch element 50 downwardly as it passes through main opening portion 36, until upper surface 82 passes through, and catch element 50 moves upwardly to the lock position "A" shown in solid lines in FIG. 1. At this point, shoulder 84 is engaged with front portion 30 of the frame to lock the door in the closed position.

To open the door 10, key 92 is inserted through key openings 16 until surface 106 contact median strip 18. Surfaces 104 meanwhile will have entered channels 60 and made contact with surfaces 62, forcing catch element 50 downwardly, to the broken line position labeled "B" in FIG. 1. With key 92 held in this position, door 10 can be opened, because the end of catch 50 is aligned with main opening portion 36, and shoulder 84 is clear of front portion 30.

If legs 54 are not sufficiently depressed, shoulders 84 will prevent opening of the door. If legs 54 are too greatly depressed, they will move to the position labeled "C" in FIG. 1, in which position shoulders 92 will engage the frame at side edges 46, and opening is again prevented. So, both legs 54 must be moved a precise distance to the open position ("B") and be held in that position to enable the door to be opened. Without using key 92, this is extremely difficult, for a number of reasons. First, the unauthorized user must depress both legs 54 to the open position, and must hold them there until catch element 50 clears opening 36. Second, the contact area on each leg is very small, and is flanked by inclined surfaces 66, which deflect such items as wires so they cannot engage and move legs 54. Third, the size and configuration of key openings 16 discourages the entry of objects such as screwdrivers.

The above described features and construction provide a simple but effective lock for towel dispenser cabinets and the like. Perhaps, modifications and variations of the specific construction disclosed above will become apparent to those skilled in the art from a viewing of this disclosure. However, it should be understood that the invention is not to be limited in scope to the specific disclosure set forth herein, but is governed only by the breadth of the appended claims:

I claim:

1. A lock for securing a door member to a frame member, said lock comprising:

means defining a lock opening having first and second edge portions on one of said members, a catch element mounted on the other of said members, said catch element having a free end portion extendable through said lock opening when said door member is closed, said free end portion having first and second locking shoulders extending outwardly in different directions, said free end portion being movable between a first position wherein said first shoulder is engageable with said first edge portion to prevent said door from being opened, a second position wherein said second shoulder is engageable with said second edge portion to prevent said door from being opened, and a third position intermediate said first and second positions wherein both of said shoulders can pass freely through said lock opening to allow said door to be opened, said free end portion being biased toward said first position, and key means engageable with said catch element to move said free end portion between said first position and said third position.

2. The lock of claim 1 wherein said free end portion is laterally movable between said first, second and third positions, wherein said other of said elements is provided with a key opening aligned with said catch element whereby said key is insertable through said key opening to engage said catch element, and further comprising key stop means for limiting the movement of said key means through said opening to that point at which said free end portions are in said third position.

3. The lock of claim 2 wherein said first shoulder extends radially outwardly from said free end portion generally in the direction of said first position, wherein said second shoulder extends radially outwardly in a direction at least generally perpendicular to that of said first shoulder.

4. The lock of claim 3 wherein said catch element is provided at the point of engagement by said key means with a first surface engageable by said key means flanked by at least one second surface inclined at an angle away from the direction of insertion of said key means to deflect away unauthorized instruments.

5. The lock of claim 3 wherein said second shoulder extends perpendicularly to said first shoulder and wherein said lock opening comprises a main portion of sufficient width to permit free passage of both of said shoulders when said free end portion is in said third position and an auxiliary portion of lesser width to preclude passage of said second shoulder when said free end portion is in said second position.

6. The lock of claim 5 wherein said catch element comprises a pair of spaced generally parallel leg members, each carrying a said free end portion having a said first shoulder and a said second shoulder, and wherein said second shoulders are out-turned in generally opposite directions from one another.

7. A lock for securing a door member to a frame member, said lock comprising:

a lock opening in one of said members, said lock opening having a first portion defined by a top edge and a pair of opposed first side edges and a second portion defined by a bottom edge and a pair of opposed second side edges, a catch element mounted on the other of said members, said catch element comprising a leg member terminating in a free end portion alignable with said lock opening, a first shoulder extending outwardly from said free end portion and engageable with said top edge, a second shoulder extending outwardly from said free end portion and engageable with one of said edges of said bottom portion, said free end portion being laterally movable between a first position wherein said first shoulder is engageable with said top edge, a second position wherein said second shoulder is engageable with one of said edges of said auxiliary portion, and a third position intermediate said first and second positions wherein both of said shoulders can pass freely through said lock opening, said free end portions being biased toward said first position, a key opening in said other of said elements aligned with said catch element, and key means insertable through said key opening in the direction of movement of said free end portion to engage said catch element to move said free end portion between said first position and said third position, said key means comprising stop means for limiting the movement of said key means so that said key means cannot move said free end portion beyond said third position toward said second position.

8. The lock of claim 7 wherein said catch element comprises a pair of spaced catch legs, each of said legs comprising a free end portion, a first shoulder and a second shoulder.

9. The lock of claim 8 further comprising a pair of said key openings in said other of said members, one of said key openings being aligned with one of said catch legs and the other of said key openings being aligned with the other of said catch legs, and wherein said key comprises a pair of spaced key legs, each of said key legs being insertable through one of said key openings to engage one of said catch legs.

10. The lock of claim 9 wherein each said key leg engages said catch leg at a catch leg contact surface, and wherein said catch leg contact surface is flanked by at least one inclined surface to deflect unauthorized objects.

11. The lock of claim 10 further comprising a pair of upstanding wall members on each of said legs on either side of said contact surface and generally parallel to said key legs to form a key leg channel, to keep said key legs from moving axially with respect to said contact surface during engagement therewith.

12. The lock of claim 9 wherein said means for limiting the movement of said key comprises a stop surface interposed between said key legs and engaging said one of said members between said key openings.

13. The lock of claim 9 wherein said second shoulders extend outwardly in opposite directions to be engageable with said second side edges, and wherein said second side edges are spaced a lesser distance from one another than are said first side edges.

14. The lock of claim 13 wherein each said free end portion further comprises an upwardly oriented inclined cam surface engageable with said top edge as said catch element enters said opening whereby said free end is cammed downwardly to pass through said opening.

15. The lock of claim 14 wherein said catch element is attached to said door member and said lock opening is in said frame member.

16. The lock of claim 11 wherein said other of said members is provided with a recess surrounding said key openings, and wherein said wall portions terminate in inclined end surfaces engageable with said recess to align said contact surface beneath said key openings when said free end portions are in said first position.

* * * * *